US011442390B2

(12) United States Patent
Shiga et al.

(10) Patent No.: US 11,442,390 B2
(45) Date of Patent: Sep. 13, 2022

(54) SHEET CONVEYING DEVICE, IMAGE READING DEVICE INCORPORATING THE SHEET CONVEYING DEVICE, IMAGE FORMING APPARATUS INCORPORATING THE SHEET CONVEYING DEVICE, AND IMAGE FORMING SYSTEM INCORPORATING THE SHEET CONVEYING DEVICE

(71) Applicants: Yuuki Shiga, Kanagawa (JP); Hideto Higaki, Kanagawa (JP); Jumpei Aoyama, Kanagawa (JP); Hirofumi Horita, Kanagawa (JP); Junpei Kamichi, Tokyo (JP)

(72) Inventors: Yuuki Shiga, Kanagawa (JP); Hideto Higaki, Kanagawa (JP); Jumpei Aoyama, Kanagawa (JP); Hirofumi Horita, Kanagawa (JP); Junpei Kamichi, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 419 days.

(21) Appl. No.: 16/260,216

(22) Filed: Jan. 29, 2019

(65) Prior Publication Data

US 2019/0243296 A1 Aug. 8, 2019

(30) Foreign Application Priority Data

Feb. 5, 2018 (JP) ..... JP2018-018644

(51) Int. Cl.
*G03G 15/00* (2006.01)
*B65H 5/06* (2006.01)

(52) U.S. Cl.
CPC ..... *G03G 15/6529* (2013.01); *B65H 5/062* (2013.01); *G03G 15/6508* (2013.01);
(Continued)

(58) Field of Classification Search
CPC ..... B65H 2404/563; B65H 2601/521; B65H 2404/6942
See application file for complete search history.

(56) References Cited

U.S. PATENT DOCUMENTS 7,215,783 B2 * 5/2007 Tsunoda ..... H04R 29/001 381/56
8,403,324 B2 * 3/2013 Shirakata ..... B65H 5/36 271/245
(Continued)

FOREIGN PATENT DOCUMENTS

JP 10-316273 12/1998
JP 2004-107051 A 4/2004
(Continued)

OTHER PUBLICATIONS

Office Action for corresponding Japanese Patent Application No. 2018-018644 dated Aug. 27, 2021.
Japanese Office Action dated Mar. 4, 2022.

*Primary Examiner* — Jennifer Bahls
(74) *Attorney, Agent, or Firm* — Harness, Dickey & Pierce, P.L.C.

(57) ABSTRACT

A sheet conveying device includes conveyance passage forming bodies to define a sheet conveyance passage, a nip forming body to form a conveying nip region in the sheet conveyance passage, and a flexible plate body having a support portion to be attached to another body and having a downstream-side end portion as a free end in a sheet conveying direction. The support portion of the flexible plate body is located on an upstream side in the sheet conveying direction with respect to the conveying nip region. The free end being located on a downstream side in the sheet conveying direction with respect to the conveying nip region.

17 Claims, 10 Drawing Sheets

(52) U.S. Cl.
CPC .. *B65H 2403/50* (2013.01); *B65H 2404/1341* (2013.01); *B65H 2404/144* (2013.01)

(56) References Cited

U.S. PATENT DOCUMENTS

| | | | | |
|---|---|---|---|---|
| 2003/0141654 | A1* | 7/2003 | Nishikata | H04N 1/0057 271/264 |
| 2004/0190928 | A1* | 9/2004 | Tsunoda | G03G 15/50 399/91 |
| 2016/0060054 | A1* | 3/2016 | Ogasawara | B65H 5/36 271/9.13 |
| 2017/0108812 | A1 | 4/2017 | Niitsuma et al. | |
| 2017/0343955 | A1 | 11/2017 | Shiga | |

FOREIGN PATENT DOCUMENTS

| | | | | |
|---|---|---|---|---|
| JP | 2005-132504 | A | | 5/2005 |
| JP | 2005-162354 | A | | 6/2005 |
| JP | 2008-050154 | A | | 3/2008 |
| JP | 2010-150042 | | | 7/2010 |
| JP | 2011-105410 | A | | 6/2011 |
| JP | 2012-035950 | | | 2/2012 |
| JP | 2013-234074 | | | 11/2013 |
| JP | 2014-005096 | A | | 1/2014 |
| JP | 2014005096 | A | * | 1/2014 |
| JP | 2017-079384 | | | 4/2017 |

* cited by examiner

SHEET CONVEYING DEVICE, IMAGE READING DEVICE INCORPORATING THE SHEET CONVEYING DEVICE, IMAGE FORMING APPARATUS INCORPORATING THE SHEET CONVEYING DEVICE, AND IMAGE FORMING SYSTEM INCORPORATING THE SHEET CONVEYING DEVICE

CROSS-REFERENCE TO RELATED APPLICATION

This patent application is based on and claims priority pursuant to 35 U.S.C. § 119(a) to Japanese Patent Application No. 2018-018644, filed on Feb. 5, 2018, in the Japan Patent Office, the entire disclosure of which is incorporated by reference herein.

BACKGROUND

Technical Field

This disclosure relates to a sheet conveying device, an image reading device incorporating the sheet conveying device, an image forming apparatus incorporating the sheet conveying device, and an image forming system incorporating the sheet conveying device.

Background Art

A known sheet conveying device includes conveyance passage defining bodies that defines a sheet conveyance passage, a nip forming member that forms a conveying nip region in the sheet conveyance passage, and a flexible plate member attached to another member with a support portion and having a free end in a downstream-side end portion in a sheet conveying direction. As a sheet conveying device of this type, there is a known configuration in which a support portion of a flexible plate member (elastic sheet member) is attached to a conveyance passage defining body (conveying guide member) on a downstream side in a sheet conveying direction with respect to a conveying nip region.

SUMMARY

At least one aspect of this disclosure provides a sheet conveying device including conveyance passage forming bodies, a nip forming body, and a flexible plate body. The conveyance passage forming bodies define a sheet conveyance passage. The nip forming body forms a conveying nip region in the sheet conveyance passage. The flexible plate body has a support portion to be attached to another body and has a downstream-side end portion as a free end in a sheet conveying direction. The support portion of the flexible plate body is located on an upstream side in the sheet conveying direction with respect to the conveying nip region. The free end is located on a downstream side in the sheet conveying direction with respect to the conveying nip region.

Further, at least one aspect of this disclosure provides an image reading device including the above-described sheet conveying device to convey a sheet, and an image reading device to read an image on the sheet conveyed by the sheet conveying device.

Further, at least one aspect of this disclosure provides an image forming system including the above-described image reading device and an image forming device to form an image based on image formation read by the above-described image reading device.

Further, at least one aspect of this disclosure provides an image forming apparatus including an image forming device to form an image on a conveyed sheet, and the above-described sheet conveying device.

Further, at least one aspect of this disclosure provides an image forming system including the above-described image reading device and an image forming apparatus including the above-described sheet conveying device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
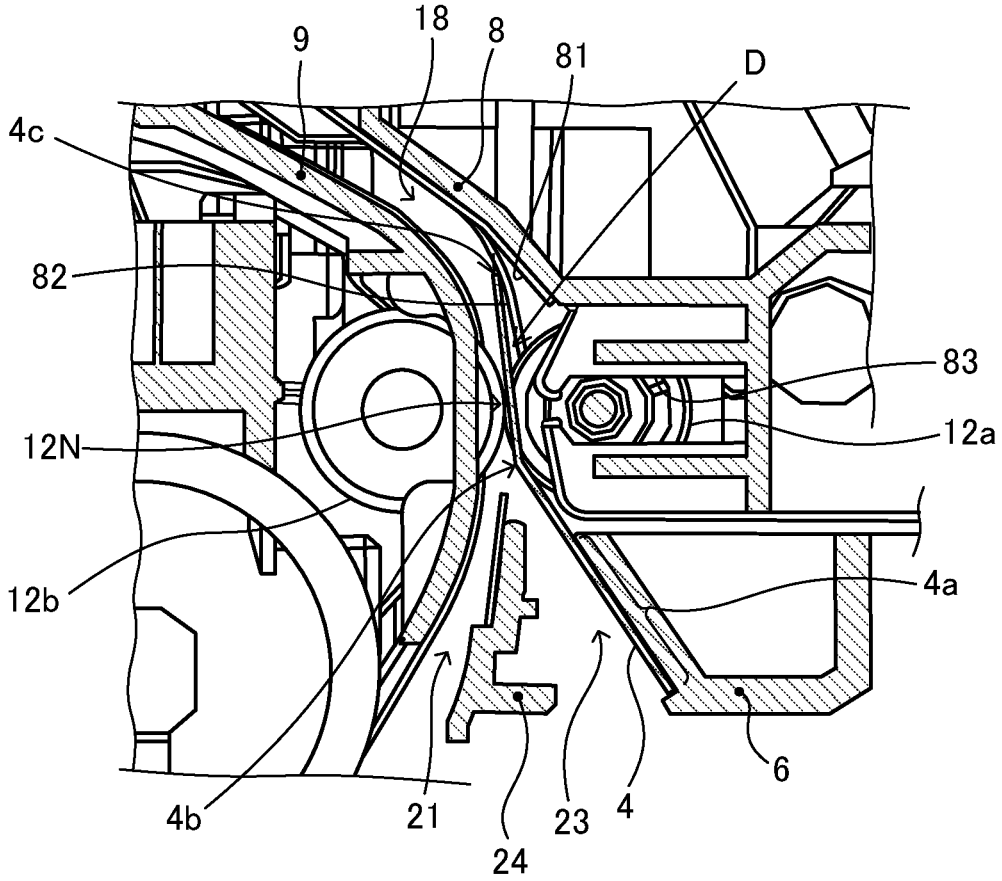
FIG. 1 is an enlarged explanatory view of a vicinity of a pair of relay rollers of an image forming apparatus.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to" or "coupled to"

another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

It is to be noted that elements (for example, mechanical parts and components) having the same functions and shapes are denoted by the same reference numerals throughout the specification and redundant descriptions are omitted.

Now, a description is given of an image forming apparatus according to an embodiment of this disclosure.

Hereinafter, embodiments of an image forming apparatus having a configuration of a sheet conveying device according to this disclosure will be described.

Figure 2:
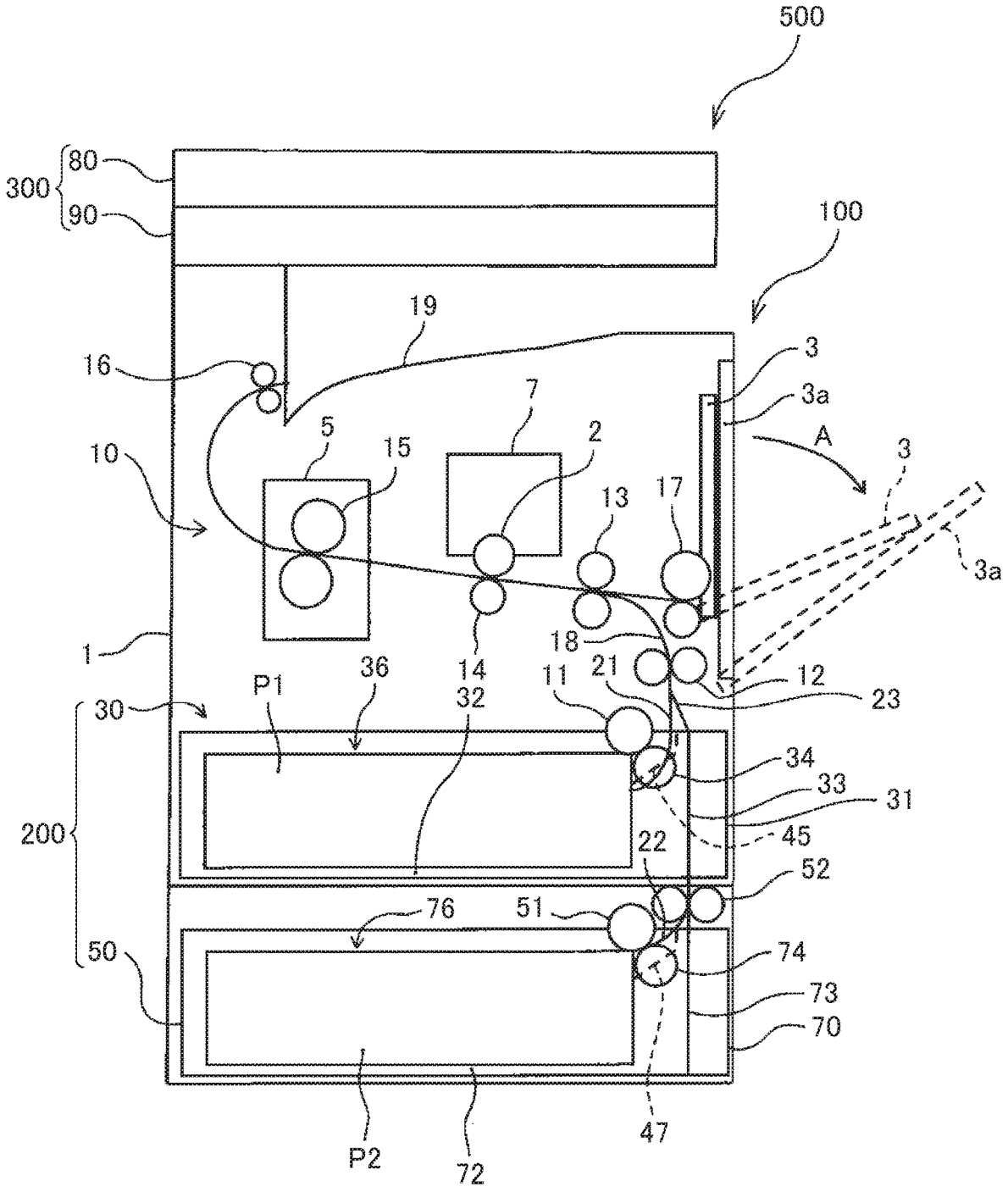
FIG. 2 is a schematic configuration diagram of a multi-functional image forming apparatus including an image forming apparatus that is an image forming apparatus according to an embodiment of this disclosure.

FIG. 2 is a schematic configuration diagram of an image forming system 500 including an image forming apparatus 100 according to the present embodiment. The image forming system 500 illustrated in FIG. 2 is a multifunction peripheral having functions of a copier, a printer, a facsimile machine, a scanner, and the like, and can record and output a full color image or a monochrome image on a recording sheet or can input the full color image or the monochrome image in a predetermined data format based on input data, for example, read image data.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

As illustrated in FIG. 2, the image forming system 500 includes the image forming apparatus 100 that functions as an image forming apparatus and a sheet conveying device, a scanner 90, and an automatic document feeder (ADF) 80 that is an automatic document feeding device above the image forming apparatus 100. The scanner 90 that functions as an image reader and the ADF 80 that functions as a sheet conveying device form an image reading device 300 as a whole.

The image forming apparatus 100 includes a main body housing 1 including an image forming device 10, and an extension sheet feeding device 50 attached below the main body housing 1. As illustrated in FIG. 2, the main body housing 1 includes a main body sheet feeder 30 including a main body sheet feeding tray 31 and a main body sheet feeding roller 11 below the image forming device 10. The extension sheet feeding device 50 includes an extension sheet feeding tray 70 and an extension sheet feeding roller 51. The main body sheet feeding tray 31 is arranged so as to be pulled out toward an apparatus front side (the right side in FIG. 2) with respect to the main body housing 1, and the extension sheet feeding tray 70 is arranged so as to be pulled out toward the apparatus front side (the right side in FIG. 2) with respect to a housing of the extension sheet feeding device 50. In the image forming apparatus 100, the main body sheet feeder 30 and the extension sheet feeding device 50 constitute a sheet feeding device 200 as a sheet feeder.

The main body sheet feeding tray 31 includes a main body tray housing 32 that forms a main body stacker 36 in which a first sheet bundle P1 is stacked, a main body sheet feeding separation roller 34, and a main body sheet feeding guide member 45. The extension sheet feeding tray 70 includes an extension tray housing 72 that forms an extension stacker 76 in which a second sheet bundle P2 is stacked, an extension sheet feeding separation roller 74, and an extension sheet feeding guide member 47.

The main body housing 1 includes a bypass sheet feeding tray 3 and a bypass sheet feeding exterior cover 3*a* on the apparatus front side (the right side in FIG. 2) of the image forming apparatus 100. When the bypass sheet feeding exterior cover 3*a* is rotated in the arrow A direction in FIG. 2 to move to the position illustrated by the broken line in FIG. 2, the bypass sheet feeding tray 3 moves to the position illustrated by the broken line in FIG. 2 in conjunction with the movement of the bypass sheet feeding exterior cover 3*a*, thereby to constitute a bypass sheet feeder to which a sheet is fed by a pair of bypass sheet feeding rollers 17.

The image forming device 10 includes a photoconductor 2 that is an image bearer, an image forming unit 7 to form a toner image on a surface of the photoconductor 2, a transfer roller 14 to transfer the toner image on the surface of the photoconductor 2 to the sheet, and a fixing device 5 to fix the toner image transferred on the transfer sheet to the transfer sheet.

In a case of forming an image by the image forming apparatus 100, an exposure unit included in the image forming unit 7 forms a latent image on the surface of the photoconductor 2, and a developing device included in the image forming unit 7 develops the latent image on the surface of the photoconductor 2 to form the toner image on the surface of the photoconductor 2. Meanwhile, sheets conveyed one by one by the sheet feeding rollers (i.e., the main body sheet feeding roller 11, the extension sheet feeding roller 51, and the pair of bypass sheet feeding rollers 17) from the sheet bundle stacked on the main body sheet feeding tray 31, the extension sheet feeding tray 70, or the bypass sheet feeding tray 3 are conveyed to a position where the sheets abut against a pair of registration rollers 13. Then, the pair of registration rollers 13 is driven to rotate in time with timing when the toner image on the surface of the photoconductor 2 reaches a transfer nip region that is a portion facing the transfer roller 14, and the toner image on the surface of the photoconductor 2 is transferred to the surface of the sheet by the transfer nip region. The toner image transferred on the sheet is fixed by heating and pressurization in the fixing device 5, and the sheet is discharged to a sheet ejection tray 19 by a pair of sheet ejection rollers 16.

Figure 3:
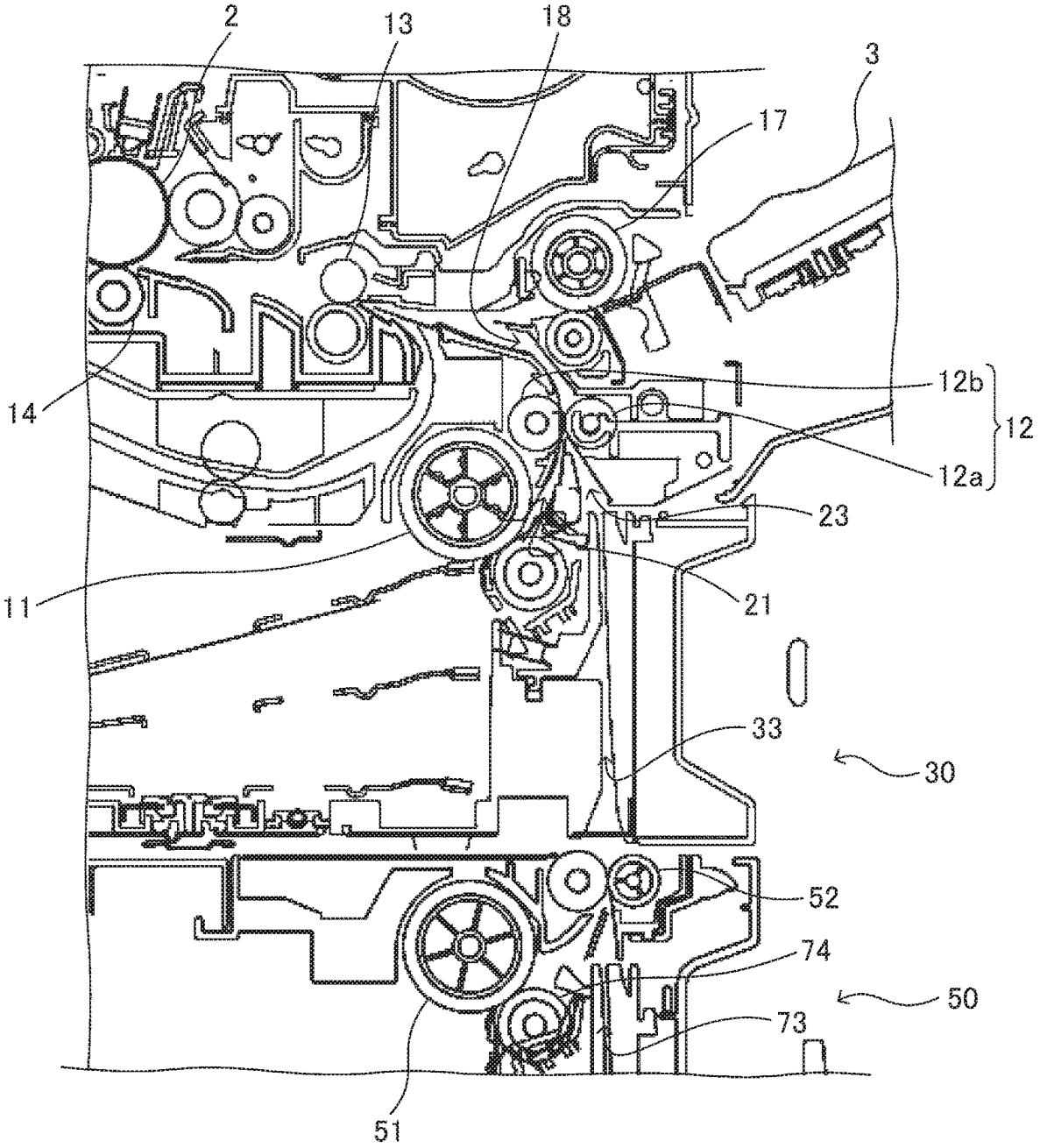
FIG. 3 is an explanatory view illustrating a sheet conveyance passage all the way to a transfer nip region in the image forming apparatus.

Next, conveyance of sheets from the main body sheet feeding tray 31 and the extension sheet feeding tray 70 will be described. FIG. 3 is an explanatory view illustrating a sheet conveyance passage all the way to the transfer nip region in the image forming apparatus 100.

In a case of feeding a sheet from the main body sheet feeding tray 31, one sheet of paper is fed from the first sheet bundle P1 by the rotation of the main body sheet feeding roller 11 provided facing the first sheet bundle P1 stacked on the main body sheet feeding tray 31. The fed sheet is conveyed by a pair of relay rollers 12, passes through a post-relay nip conveyance passage 18, and abuts against the pair of registration rollers 13. Next, the pair of registration rollers 13 conveys the sheet as the pair of registration rollers 13 is driven, the transfer roller 14 transfers the toner image on the photoconductor 2 to the sheet by the arranged transfer nip region, and the fixing device 5 including a pair of fixing rollers 15 fixes the toner image on the sheet. After the fixation of the toner image, the sheet is discharged to the sheet ejection tray 19 by the pair of sheet ejection rollers 16.

In the image forming apparatus 100, a conveying speed by the pair of relay rollers 12 is set to be faster than a conveying speed by the pair of registration rollers 13. Then, when the sheet P is gripped by the pair of registration rollers 13 and becomes ready to be conveyed by the pair of registration rollers 13, an input of driving to the pair of relay rollers 12 is stopped, and the pair of relay rollers 12 rotates together with the movement of the sheet P conveyed by the pair of registration rollers 13.

In a case of feeding a sheet from the extension sheet feeding tray 70, one sheet of paper is fed from the second sheet bundle P2 by the rotation of the extension sheet feeding roller 51 provided facing the second sheet bundle P2 stacked on the extension sheet feeding tray 70. The fed sheet is conveyed by a pair of extension sheet feeding conveying rollers 52 provided in the extension sheet feeding device 50, passes through a main body sheet feeding tray through conveyance passage 33 provided in the main body sheet feeding tray 31, and is conveyed to a downstream side in a sheet feeding direction by the pair of relay rollers 12.

The extension sheet feeding tray 70 includes an extension sheet feeding tray through conveyance passage 73 to be located in the same straight line with the main body sheet feeding tray through conveyance passage 33, so that the extension sheet feeding tray 70 having the same shape can be added below the main body sheet feeding tray 31. When the extension sheet feeding tray 70 having the same shape is added, the sheet fed from the added extension sheet feeding tray 70 passes through the extension sheet feeding tray through conveyance passage 73 of the extension sheet feeding tray 70 above the extension sheet feeding tray 70 on which the sheet has been placed. Then, the sheet is conveyed from the extension sheet feeding tray through conveyance passage 73 to the main body sheet feeding tray through conveyance passage 33, passes through the main body sheet feeding tray through conveyance passage 33, and is conveyed to the downstream side in the sheet feeding direction by the pair of relay rollers 12.

As illustrated in FIG. 2, the main body sheet feeder 30 includes a main body sheet feeding and conveyance passage 21 that guides the sheet immediately after fed from the main body sheet feeding tray 31 by the main body sheet feeding roller 11 toward a nip portion of the pair of relay rollers 12 above the main body sheet feeder 30. Further, the extension sheet feeding device 50 includes an extension sheet feeding and conveyance passage 22 that guides the sheet immediately after fed from the extension sheet feeding tray 70 by the extension sheet feeding roller 51 toward a nip portion of the pair of extension sheet feeding conveying rollers 52 above the extension sheet feeding device 50. Further, the main body sheet feeder 30 includes an extension sheet feeding and guiding passage 23 that guides the sheet having passed through the nip portion of the pair of extension sheet feeding conveying rollers 52 and having passed through the main body sheet feeding tray through conveyance passage 33 toward the nip portion of the pair of relay rollers 12.

FIG. 1 is an enlarged explanatory view of a vicinity of the pair of relay rollers 12 of the image forming apparatus 100. The image forming apparatus 100 includes a relay upstream guide member 6, a relay downstream guide member 8, a relay inner guide member 9, and a merging guide member 24 as conveyance passage defining bodies that define the main body sheet feeding and conveyance passage 21, the extension sheet feeding and guiding passage 23, and the post-relay nip conveyance passage 18 as sheet conveyance passages. Further, the image forming apparatus 100 includes the pair of relay rollers 12 that forms a relay nip region 12N in the sheet conveyance passage between the main body sheet feeding and conveyance passage 21 and the extension sheet feeding and guiding passage 23, and the post-relay nip conveyance passage 18. The pair of relay rollers 12 includes a relay outer roller 12*a* and a relay inner roller 12*b*. When the relay inner roller 12*b* as a drive roller is driven to rotate in a counterclockwise direction in FIG. 1, the relay outer roller 12*a* is driven to follow in a clockwise direction in FIG. 1 to convey the sheet P gripped by the relay nip region 12N in an upward direction in FIG. 1 that is a downstream side in the sheet conveying direction. The relay nip region 12N is located at a merging portion between the two upstream sheet conveyance passages of the main body sheet feeding and conveyance passage 21 and the extension sheet feeding and guiding passage 23.

Further, as illustrated in FIG. 1, a flexible sheet 4 arranged to straddle the relay nip region 12N in the sheet conveyance passage is provided. An upstream-side secured portion 4*a* including an upstream-side end portion of the flexible sheet 4 is affixed and secured to the relay upstream guide member 6 on the upstream side with respect to the relay nip region 12N. Further, a sheet downstream end 4*c* of a downstream-side end portion in the sheet conveying direction of the flexible sheet 4 is located on a downstream side in the sheet conveying direction with respect to the relay nip region 12N.

Figure 4:
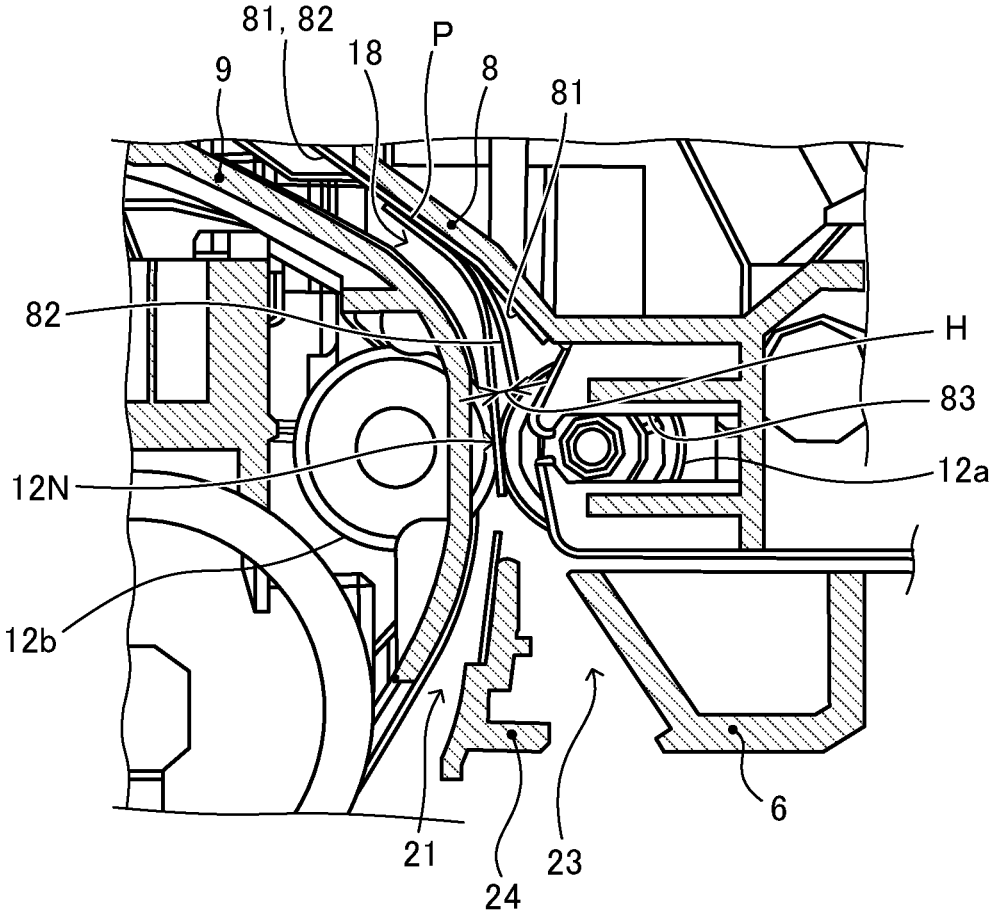
FIG. 4 is an enlarged explanatory view of a vicinity of a pair of relay rollers immediately before a sheet passes through a relay nip region in a state where a flexible sheet is detached.
Figure 5:
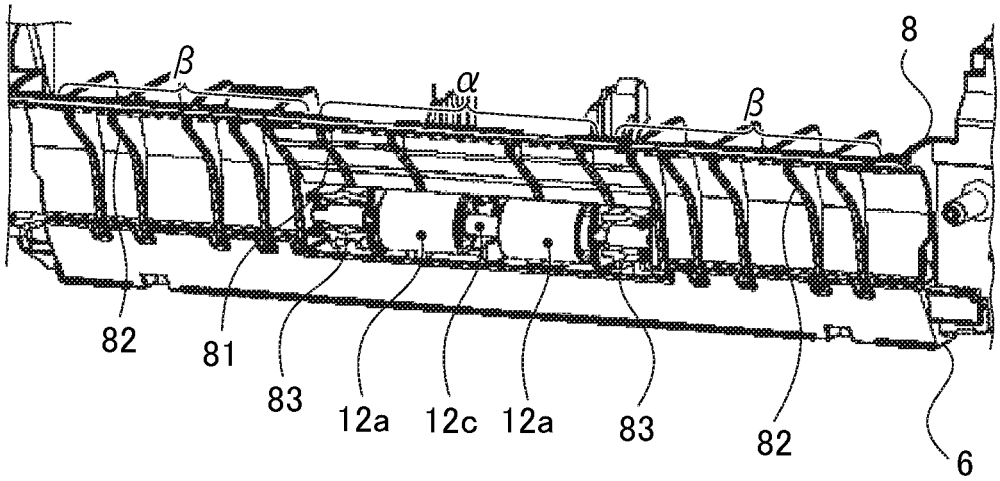
FIG. 5 is a perspective explanatory view of a relay upstream guide member, a relay downstream guide member, and a relay outer roller in a state where the flexible sheet is detached.
Figure 6:
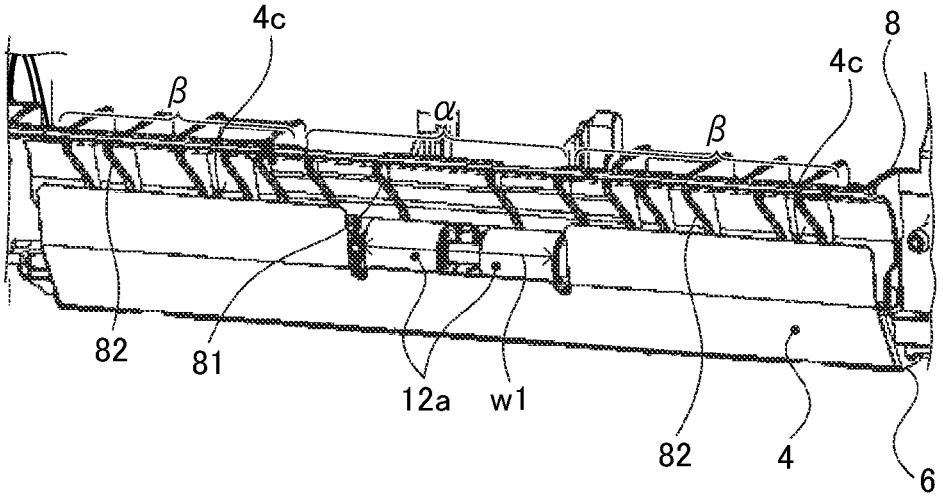
FIG. 6 is a perspective explanatory view of the relay upstream guide member, the relay downstream guide member, and the relay outer roller in a state where the flexible sheet is attached.
Figure 7:
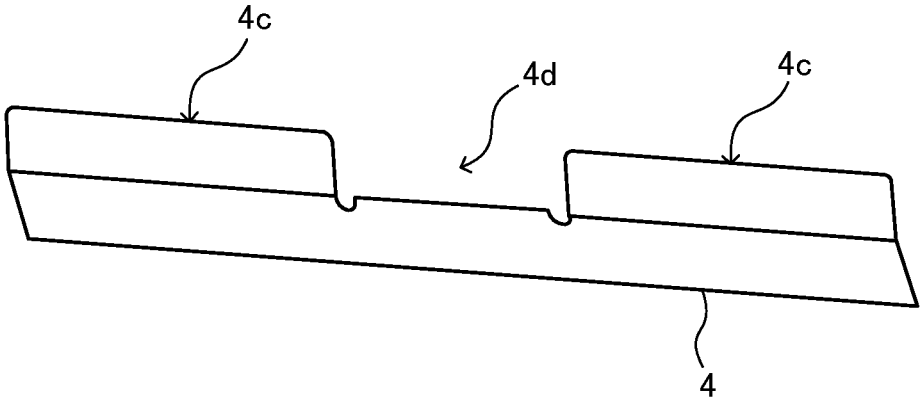
FIG. 7 is a perspective explanatory view of the flexible sheet.
Figure 8:
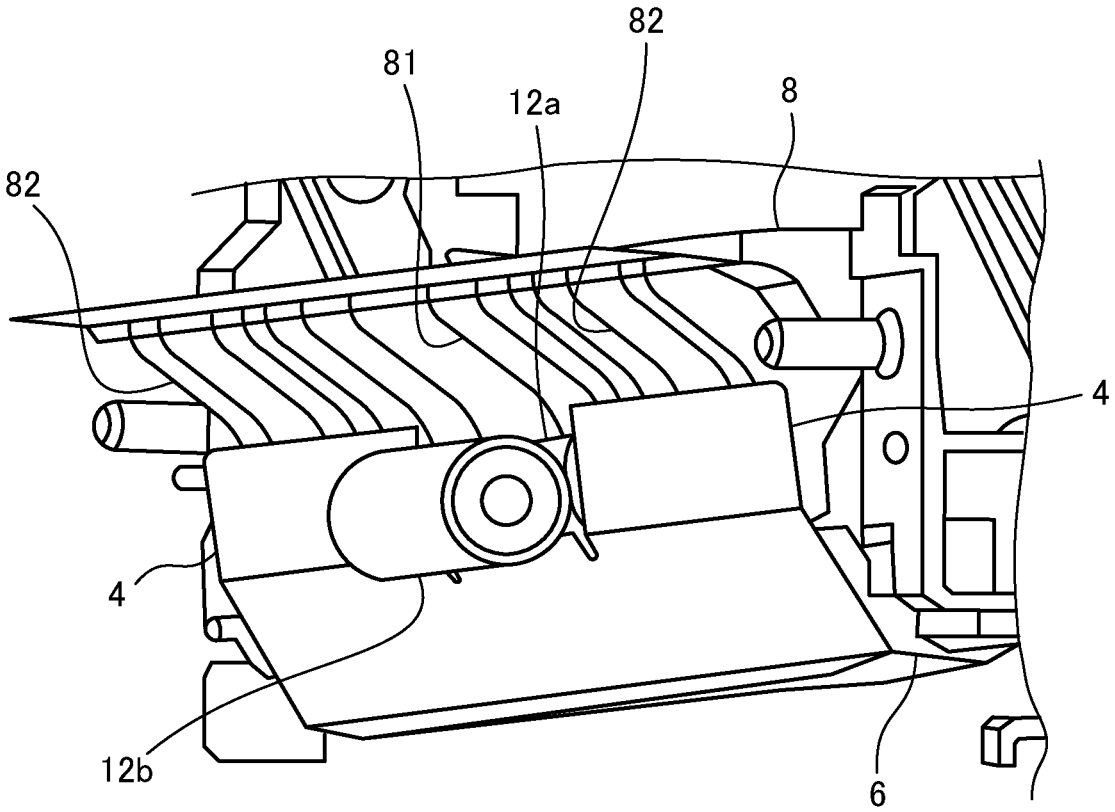
FIG. 8 is a perspective explanatory view of the relay upstream guide member, the relay downstream guide member, the relay outer roller, and a relay inner roller in a state where the flexible sheet is attached.

FIG. 4 is an enlarged explanatory view of a vicinity of the pair of relay rollers 12 immediately before the sheet P passes through the relay nip region 12N in the image forming apparatus 100 in a state where the flexible sheet 4 is detached. FIG. 5 is a perspective explanatory view of the relay upstream guide member 6, the relay downstream guide member 8, and the relay outer roller 12*a* in a state where the flexible sheet 4 is detached. FIG. 6 is a perspective explanatory view of the relay upstream guide member 6, the relay downstream guide member 8, and the relay outer roller 12*a* in a state where the flexible sheet 4 is attached, and FIG. 7 is a perspective explanatory view of the flexible sheet 4. FIG. 8 is a perspective explanatory view of the relay upstream guide member 6, the relay downstream guide member 8, the relay outer roller 12*a*, and the relay inner roller 12*b* in a state where the flexible sheet 4 is attached.

As illustrated in FIGS. 4 and 5, the relay downstream guide member 8 protrudes toward a position where the conveyed sheet P passes through, and includes, in a width direction, a plurality of ribs (that is, an inner rib 81 and an outer rib 82) extending in the sheet conveying direction. Further, the relay downstream guide member 8 has a shape in which an inner region α including a range where the pair of relay rollers 12 is arranged in the width direction is located at a position more distant in a normal direction of the surface of the sheet P from a position where the conveyed sheet P passes through than an outer region β outside in the width direction of the inner region α. Specifically, the ribs included in the relay downstream guide member 8 have a shape in which the outer rib 82 provided in the outer region β protrudes more than the inner rib 81 provided in the inner region α.

The outer rib 82 more protrudes than the inner rib 81, and as illustrated in FIG. 4, there is a difference in level H between a surface of the relay outer roller 12*a* immediately after passing through the relay nip region 12N and a leading end of the outer rib 82. On a downstream side of the relay nip region 12N provided in a turn portion where the sheet conveyance passage curves, the conveyed sheet P is bent along the turn portion and moves while being in contact with the guide member outside the turn portion, as illustrated in FIG. 4. In a case in which the sheet P is conveyed in a state without including the flexible sheet 4, when a trailing end of the sheet P passes through the relay nip region 12N, the trailing end of the sheet P is moved to bounce by the difference in level H due to stiffness of the sheet P and a vicinity of the trailing end of the sheet P collides with the relay downstream guide member 8, and a collision noise occurs.

In the image forming apparatus 100 of the present embodiment, the flexible sheet 4 for guiding entry of the sheet P into the relay nip region 12N is extended to the downstream side in the sheet conveying direction from the outside in the width direction of the pair of relay rollers 12. As illustrated in FIGS. 1 and 6, the flexible sheet 4 is arranged to cover the difference in level H between the surface of the relay outer roller 12*a* immediately after passing through the relay nip region 12N and the relay downstream guide member 8. Therefore, the flexible sheet 4 can receive the trailing end of the sheet P before the trailing end of the sheet P collides with the relay downstream guide member 8 at the level difference portion, and can reduce the distance where the sheet P is moved to bounce.

Figure 9:
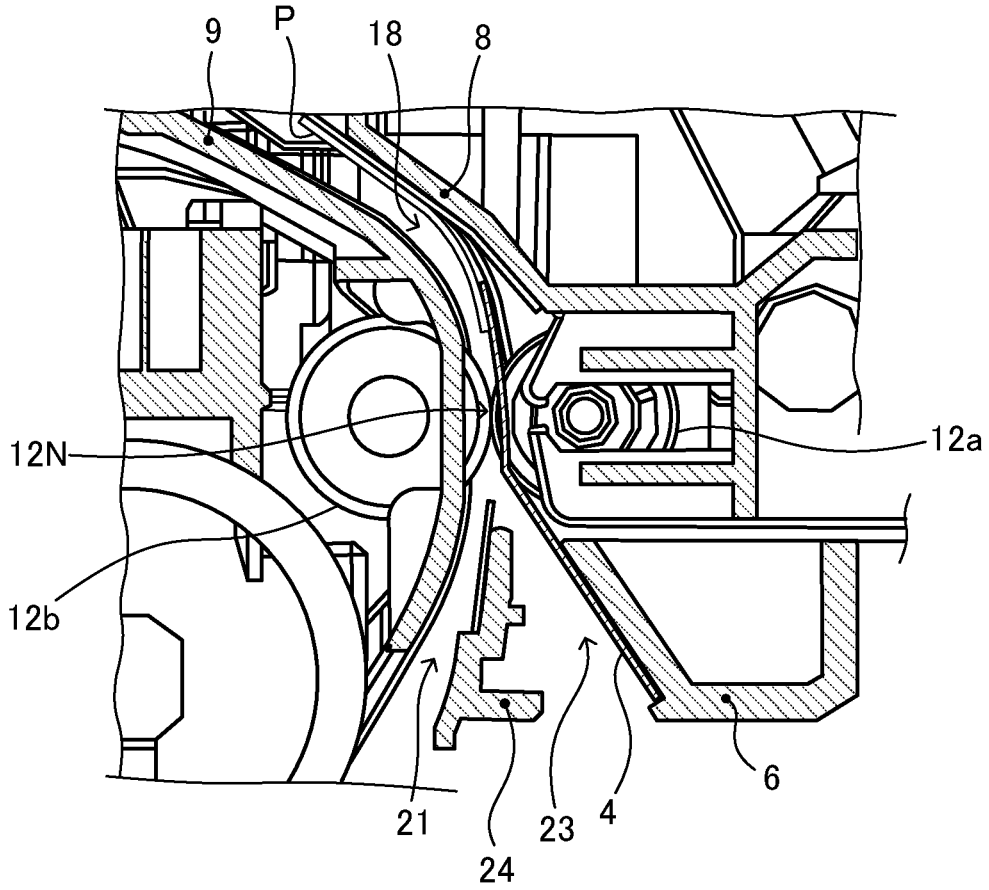
FIG. 9 is an enlarged explanatory view of a vicinity of the pair of relay rollers in a state where a trailing end of a sheet collides with the flexible sheet.

FIG. 9 is an enlarged explanatory view of a vicinity of the pair of relay rollers 12 in a state where the trailing end of the sheet P collides with the flexible sheet 4. The flexible sheet 4 and the relay downstream guide member 8 are not secured, and a space D is provided between the flexible sheet 4 and the relay downstream guide member 8, as illustrated in FIG. 1. Therefore, when the sheet P collides with the flexible sheet 4, the downstream side in the sheet conveying direction of the flexible sheet 4 can be moved and bent to narrow the space D. The flexible sheet 4 functioning as a damper can decrease the collision noise generated when the trailing end of the sheet P collides with the member that defines the conveyance passage.

The sheet downstream end 4*c* of the flexible sheet 4 secured to the relay upstream guide member 6 on the upstream side of the relay nip region 12N is a free end, and the flexible plate member deformable across the position of the relay nip region 12N is provided from the upstream side to the downstream side of the relay nip region 12N. With the configuration, the collision noise with the conveyance passage defining body immediately after the sheet P has passed through the relay nip region 12N can be decreased without affecting an increase in size of the apparatus, for example, the image forming apparatus 100 and conveyability of the sheet P.

As illustrated in FIG. 1, the flexible sheet 4 is bent on a downstream side in the sheet conveying direction with respect to the secured portion 4*a* to form a sheet folded portion 4*b*, and a sheet conveying surface side of the sheet folded portion 4*b*, the side coming in contact with the sheet P, is bent in a manner of a mountain fold. Even if the relay nip region 12N is not located in an extending direction of the flexible sheet 4 in the secured portion of the flexible sheet 4, the downstream side in the sheet conveying direction of the flexible sheet 4 can be brought to face the relay nip region 12N by folding the flexible sheet 4. In a case in which the folded portion is valley folded, the folded portion may affect the conveyability such as the sheet P being caught on a fold or a depressed portion, or the conveyance passage becoming narrow. In contrast, the mountain folded portion does not affect the conveyability of the sheet P.

Further, the sheet folded portion 4*b* is located on the upstream side with respect to the relay nip region 12N. If the fold position is located on the downstream side in the sheet conveying direction with respect to the relay nip region 12N, the sheet having passed through the relay nip region 12N passes through a position near the fold position and is thus easily loaded. Since the load becomes smaller as the position is more distant from the fold position, the sheet folded portion 4*b* as the fold position is provided on the upstream side in the sheet feeding direction with respect to the relay nip region 12N, thereby not to affect the conveyability of the sheet P having passed through the relay nip region 12N.

The flexible sheet 4 is arranged to cause the sheet downstream end 4*c* to be in contact with the relay downstream guide member 8. If the sheet downstream end 4*c* of the flexible sheet 4 is not contact with the relay downstream guide member 8 and is in a floating state, the position of the sheet downstream end 4*c* varies, and the position to which the sheet P guided while being in contact with the flexible sheet 4 is conveyed varies. By arranging the flexible sheet 4 to cause the sheet downstream end 4*c* to be in contact with the relay downstream guide member 8, the position of the sheet downstream end 4*c* is stabilized and the stability of conveyance of the sheet P is enhanced. In the present embodiment, a folding amount at the sheet folded portion 4*b* is adjusted so that the sheet downstream end 4*c* of the flexible sheet 4 is in contact with the relay downstream guide member 8.

As described above, the outer rib 82 has a shape more protruding than the inner rib 81. Therefore, the inner rib 81 in the inner region α including the region where the relay outer roller 12*a* is arranged is at a more retracted (secluded) position from the position where the sheet P passes through than the outer ribs 82 in the outer regions 13 that are regions on both sides of the inner rib 81. This is to prevent a leading edge of the sheet P having passed through the relay nip region 12N from being caught on the upstream-side end portion of the inner rib 81. However, if the width of the sheet P to be conveyed is short, the collision noise may occur when the trailing end of the sheet P having passed through the relay nip region 12N collides with the inner rib 81 in the inner region α. In contrast, in the image forming apparatus 100, the flexible sheet 4 is arranged to straddle the inner rib 81 and the outer rib 82, as illustrated in FIG. 6. With the arrangement, the trailing end of the sheet P can be received by the flexible sheet 4 even if the width of the sheet P is short.

As a comparative example, there is a known configuration in which protruding guide portions protruding more upward toward downstream in a sheet conveying direction than central portions are provided on both ends in a width direction (conveyance passage width direction) orthogonal to a sheet conveying direction of a conveying guide member. Then, a level difference when a trailing end of a sheet is delivered from the protruding guide portions to a protruding guide portion of a merging guide member can be made small as the protruding guide portions are pushed and bent, and collision noise caused by the trailing end of the sheet at the level difference of the merging portion between the conveyance passages can be decreased.

However, the protruding guide portions of the comparative example are provided to protrude from the guide member downstream of a roller nip region. The guide member does not have a configuration to cover a level difference portion between a roller surface immediately after the sheet has passed through a pair of rollers and a surface of the conveyance passage defining body. Therefore, the guide member cannot prevent occurrence of collision noise caused by a collision of the trailing end of the sheet immediately after passing through the roller nip region with the surface of the conveyance passage defining body.

In contrast, in the image forming apparatus 100 of the present embodiment, the flexible sheet 4 is arranged to cover the difference in level H between the surface of the relay outer roller 12*a* immediately after passing through the relay nip region 12N and the surface of the post-relay nip conveyance passage 18. With the arrangement, the noise occurring when the trailing end of the sheet P collides with the post-relay nip conveyance passage 18 at the difference in level H can be decreased.

Further, in the present embodiment, the portion other than a roller avoiding portion 4*d* provided to avoid the pair of relay rollers 12 in the width direction is arranged to cover the entire post-relay nip conveyance passage 18 in the width direction. With the arrangement, when conveying the sheet P with a short width, the noise occurring when the trailing end of the sheet P having passed through the pair of relay rollers 12 collides with the post-relay nip conveyance passage 18 can be decreased.

In the present embodiment, the flexible sheet 4 is arranged in the turn portion where the sheet conveyance passage curves and the sheet P passes through from the pair of relay rollers 12. However, the portion where the flexible sheet 4 is arranged is not limited to the turn portion, and this disclosure can be applied to any portion where the pair of rollers of the sheet conveyance passage is arranged. This is because there is a difference in level between the roller surface immediately after passing through the nip portion formed if not by the turn, by the pair of rollers, and the surface of the conveyance passage defining body that defines the sheet conveyance passage downstream of the nip portion. There is a possibility that the trailing end of the sheet having passed through the nip portion bounces and collides with the conveyance passage defining body in a state where there is a difference in level immediately after the nip portion and a force toward the conveyance passage defining body is acting on the trailing end of the sheet. By arranging the flexible sheet at the place that the trailing end of the sheet may collide with, occurrence of the collision noise can be prevented.

Further, if a secured portion of the flexible sheet 4 is provided on a downstream side with respect to the relay nip region 12N, the length of the secured portion needs to be ensured on the downstream side with respect to the pair of relay rollers 12, and there is a possibility that the trailing end of the sheet P having passed through the relay nip region 12N collides with the secured portion. Since the secured portion of the flexible sheet 4 is secured to the conveyance passage defining body having no flexibility, the secured portion is less likely to function as a damper that absorbs collision energy, and the effect of reducing the collision noise cannot be expected.

Further, when the sheet P collides with the flexible sheet 4 located downstream of the secured portion provided downstream of the relay nip region 12N, the flexible sheet 4 is displaced in a direction of absorbing the collision, but the sheet P collides with a place with a short distance from the secured portion. An amount of displacement of the flexible sheet 4 when a force having the same magnitude acts on is larger and more easily absorbs the collision energy as the distance from the secured portion is longer. Therefore, if the distance from the secured portion to the position that the trailing end of the sheet P collides with is short, the amount of displacement of the flexible sheet 4 is small and the flexible sheet 4 cannot sufficiently absorb the collision energy and cannot sufficiently decrease the collision noise.

In contrast, in the present embodiment, the secured portion of the flexible sheet 4 is provided on the upstream side with respect to the relay nip region 12N. Therefore, the distance from the portion with which the trailing end of the sheet P having passed through the relay nip region 12N collides and the secured portion 4*a* in the flexible sheet 4 can be ensured. Therefore, the portion with which the trailing end of the sheet P collides is easily displaced in the direction of absorbing the collision and can easily absorb the collision energy, thereby to decrease the collision noise.

Further, since the secured portion 4*a* of the flexible sheet 4 is provided on the upstream side with respect to the relay nip region 12N, the elastically deformable portion of the flexible sheet 4 guides the sheet P toward the relay nip region 12N between the relay nip region 12N and the secured portion 4*a*. In the configuration in which the pair of relay rollers 12 is arranged only in the central portion in the width direction as in the image forming apparatus 100, the central portion of the sheet P gripped by the pair of relay rollers 12 is deformed to protrude inward in the turn portion, as compared with both end portions not gripped by the pair of relay rollers 12. At this time, by guiding the sheet P toward the relay nip region 12N by the elastically deformable portion of the flexible sheet 4, sudden deformation of the sheet P entering the relay nip region 12N can be restrained and damage to the sheet P due to noise or deformation caused at the time of deformation can be restrained.

Further, the leading edge of the sheet P conveyed toward the relay nip region 12N comes into contact with the flexible sheet 4, and is guided by the flexible sheet 4 and enters the relay nip region 12N. Since the leading edge of the sheet P is guided along the flexible sheet 4, a smooth surface of the flexible sheet 4 is favorable. Further, an insulator is desirable so as not to be frictionally charged due to rubbing of the sheet P. The flexible sheet 4 is made of a material having elasticity so that the flexible sheet 4 can be deformed and absorb the collision energy. An example of the material used for the flexible sheet 4 includes, but is not limited to, terephthalic acid polyester.

The relay downstream guide member 8 as the conveyance passage defining body is provided with the ribs (81 and 82) on the surface where the sheet conveyance passage is formed. With the ribs, the contact area between the sheet P and the conveyance passage defining body is reduced, and conveyance resistance by rubbing the conveyance passage defining body by the sheet P is decreased. However, in the portion covered with the flexible sheet 4, the rib does not come into contact with the sheet P and does not exhibit the function. Therefore, the portion not covered with the flexible sheet 4 may not have the rib.

In the image forming apparatus 100, the sheet P having passed through the main body sheet feeding and conveyance passage 21 and the sheet P having passed through the extension sheet feeding and guiding passage 23 both come in contact with the flexible sheet 4 and are guided to the relay nip region 12N. Then, after the sheets P have been conveyed from the upstream-side sheet conveyance passages, the trailing end of either of the sheets P that has passed through the relay nip region 12N comes in contact with the flexible sheet 4.

As illustrated in FIG. 5, the relay upstream guide member 6 and the relay downstream guide member 8 of the present embodiment are separate members and have a joint. If the joint is exposed, the sheet P may be caught on the joint. However, in the present embodiment, the joint is covered with the flexible sheet 4, and thus the sheet P can be prevented from being caught on the joint of the conveyance passage defining body.

As illustrated in FIG. 5, the relay downstream guide member 8 includes a roller shaft holder 83 that holds a rotation shaft 12*c* of the relay outer roller 12*a*. Then, as illustrated in FIG. 6, the flexible sheet 4 is arranged to cover the roller shaft holder 83 and is extended to positions close to outer end portions in the width direction of the relay outer roller 12*a*. With the arrangement, the trailing end of the sheet P can be received by the flexible sheet 4 even if the width of the sheet P is short.

The width of the roller avoiding portion 4*d* of the flexible sheet 4 is longer than the length in the width direction of the relay outer roller 12*a* ("W1" in FIG. 6) and is shorter than the width of the minimum size of the sheet P to be conveyed (i.e., the width of the sheet P having the minimum size conveyable in the image forming apparatus 100). With the configuration, even when the sheet P having the minimum size is conveyed, the collision noise with the conveyance passage defining body immediately after the sheet P has passed through the relay nip region 12N can be decreased.

In the image forming apparatus 100 of the present embodiment, the collision noise of the sheet P having passed through the relay nip region 12N with the conveyance passage defining body is decreased, thereby decreasing operating sound of the image forming apparatus 100.

Figure 10:
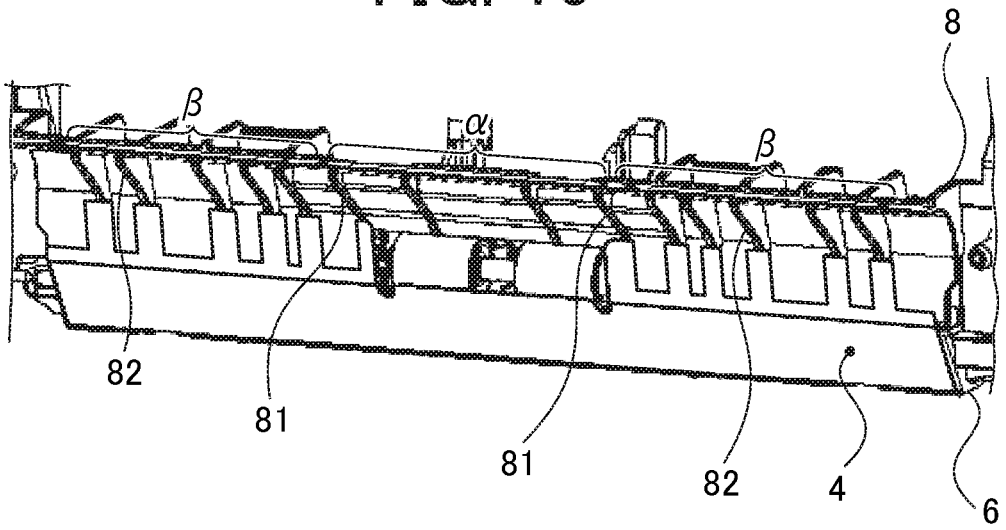
FIG. 10 is a perspective explanatory view of the relay upstream guide member, the relay downstream guide member, and the relay outer roller in a state where a flexible sheet having a comb-teeth shape is attached.

FIG. 10 is a perspective explanatory view of the relay upstream guide member 6, the relay downstream guide member 8, and the relay outer roller 12*a* in a state where a flexible sheet 4 is attached. The flexible sheet 4 illustrated in FIG. 10 has a plurality of notches extending in the sheet conveying direction and has a comb-teeth shape. With the plurality of notches, the flexible sheet 4 becomes easily deformed and can easily absorb the collision energy, thereby easily reducing the collision noise.

Further, the relay downstream guide member 8 illustrated in FIG. 10 protrudes toward the position where the conveyed sheet P passes through, and includes, in the width direction, the plurality of ribs (81 and 82) extending in the sheet conveying direction. Then, the portion other than the notches in the flexible sheet 4 is arranged to face the ribs. With the arrangement, the configuration provided with the notches prevents the trailing end of the sheet P having passed through the relay nip region 12N from directly colliding with the ribs of the relay downstream guide member 8, and can reduce the collision noise.

The flexible sheet 4 is affixed to the relay upstream guide member 6 to cover a range of the relay upstream guide member 6 in the sheet conveying direction, where the sheet P may come in contact with. Specifically, the flexible sheet 4 is affixed to cover the entire inclined surface of the relay upstream guide member 6 illustrated in FIG. 1. With the configuration, when the leading edge of the sheet P conveyed from the upstream side comes in contact with the relay upstream guide member 6, the leading edge comes in contact with the relay upstream guide member 6 across the flexible sheet 4 and then keeps in contact with the flexible sheet 4 when moving along the relay upstream guide member 6. This prevents the leading edge of the sheet P moving along the relay upstream guide member 6 from being caught on the level difference in the upstream-side end portion of the flexible sheet 4 affixed to the relay upstream guide member 6.

In the present embodiment, the configuration provided with the pair of relay rollers 12 in the merging portion between the main body sheet feeding and conveyance passage 21 and the extension sheet feeding and guiding passage 23 has been described. However, the portion where the pair of relay rollers 12 is provided is not limited to the merging portion, and a configuration provided with the flexible sheet 4 near the pair of relay rollers 12 arranged in the middle of one of the sheet conveyance passages may be adopted.

Figure 11:
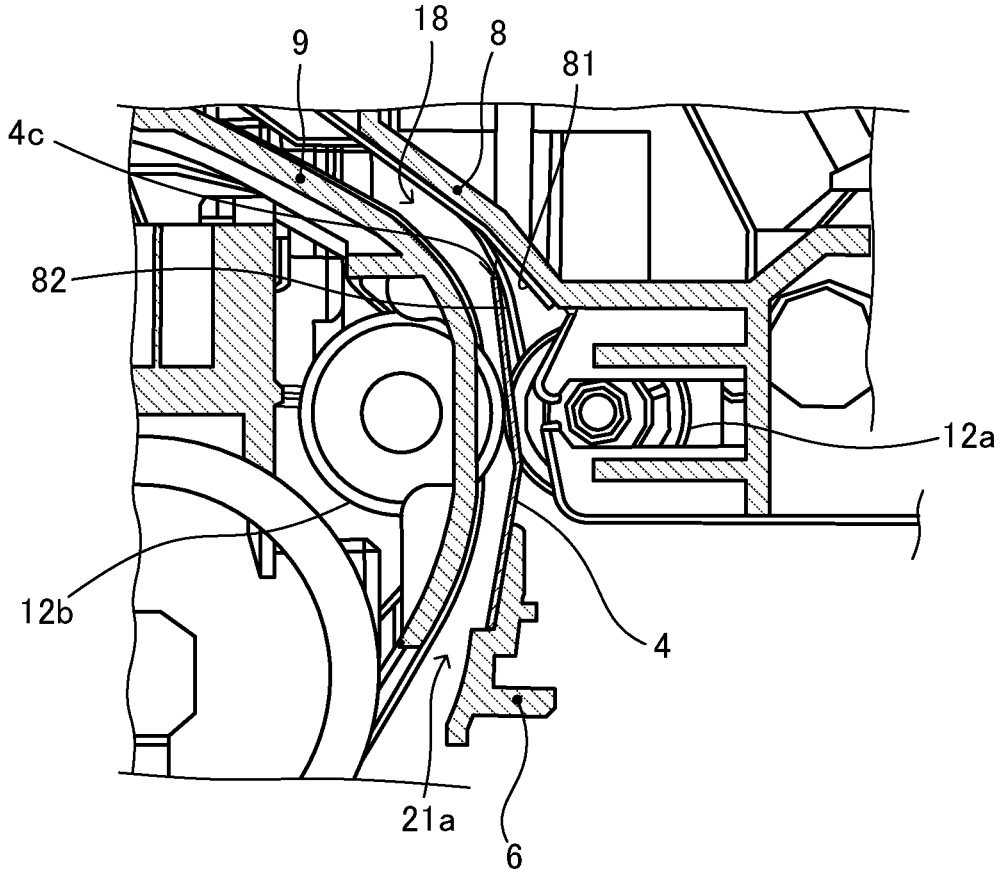
FIG. 11 is an enlarged explanatory view of a vicinity of the pair of relay rollers arranged in the middle of one sheet conveyance passage.

FIG. 11 is an enlarged explanatory view of a vicinity of the pair of relay rollers 12 arranged in the middle of one sheet conveyance passage. In contract with the configuration illustrated in FIG. 1, the extension sheet feeding and guiding passage 23 is not provided, and the position of the relay upstream guide member 6 is different. As the sheet conveyance passages, a pre-relay nip conveyance passage 21*a* and the post-relay nip conveyance passage 18 are provided, and as the conveyance passage defining bodies that define the sheet conveyance passages, the relay upstream guide member 6, the relay downstream guide member 8, and the relay inner guide member 9 are provided.

Even with such a configuration, the collision noise with the conveyance passage defining body immediately after the sheet P has passed through the relay nip region 12N can be decreased by arranging the flexible sheet 4 as illustrated in FIG. 11.

The apparatus having the configuration of the sheet conveying device according to this disclosure is not limited to the image forming apparatus as in the image forming apparatus 100 according to the embodiment. For example, the sheet conveying device according to this disclosure can be applied to a sheet processing device such as a finisher that performs a binding process, a punching process, a folding process, or the like on a sheet on which an image is formed by the image forming apparatus. Further, the configuration of the sheet conveying device according to this disclosure can also be applied to a document conveying device, for example, the ADF 80. Furthermore, the configuration of the sheet conveying device according to this disclosure can also be applied to a sheet feeding device, for example, the sheet feeding device 200.

Variation.

Figure 12:
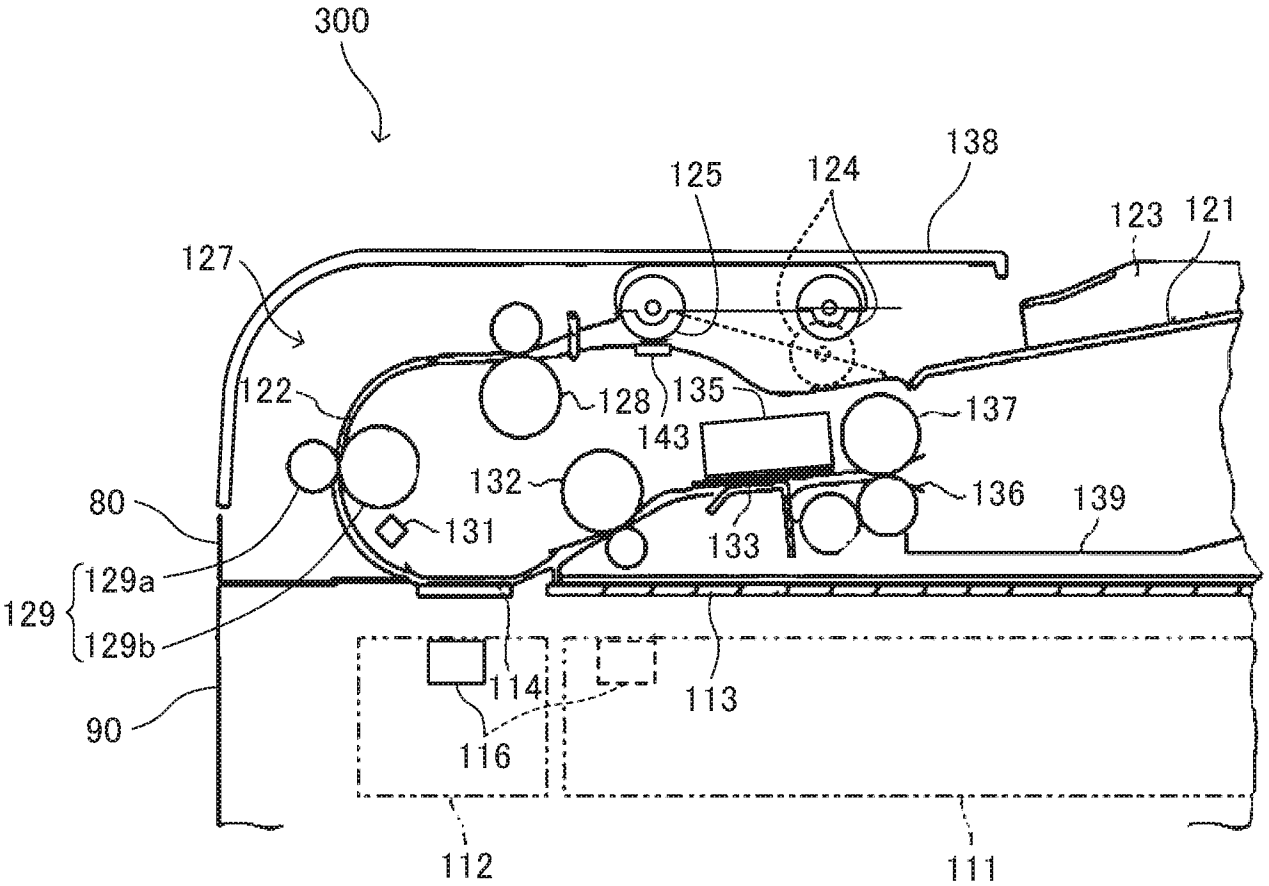
FIG. 12 is a schematic configuration diagram of an image reading device according to a variation.

Hereinafter, a configuration in which the configuration of the sheet conveying device according to this disclosure is applied to the ADF 80 will be described as a variation. FIG. 12 is a schematic configuration diagram of the image reading device 300 according to the variation. The image reading device 300 is switchable between a flatbed scanner mode (placed document reading mode) and a DF scanner mode (conveyed document reading mode).

The flatbed scanner mode is a mode executed when a read start request operation such as pressing of a copy start button is made in a state where a document is placed on a flatbed contact glass 113 above the scanner 90, and to read an image of the placed document. An image surface of the document is irradiated with light while moving an image reader 116 in a moving reading region 111 right under the flatbed contact glass 113. Then, reflected light from the image surface of the document is converted into an image signal, so that the image of the document is read. The DF scanner mode is a mode to stop the image reader 116 in a stop reading region 112 right under a DF contact glass 114, and read an image of a conveyed document.

In the DF scanner mode, the ADF 80 separates document sheets one by one from a document sheet bundle stacked on a document placing tray 121 (document placing table), carries the document sheet in a document conveyance passage 122 and conveys the sheet along the document conveyance passage 122. Then, during the conveyance, the document sheet is brought to sequentially partially face an upper surface of the DF contact glass 114 from an upstream-side portion in a sheet conveying direction.

The ADF 80 is attached to a rear portion (a portion on the back side) of the upper surface side of the scanner 90 via an opening and closing mechanism such as a hinge. Further, the ADF 80 can take an open position where the flatbed contact glass 113 is opened to the scanner 90 and a closed position where the document on the flatbed contact glass 113 can be pressed.

The image reader 116 may be any reader as long as the reader can repeatedly line-scan and read an image on a front side of a document at a predetermined image reading position, for example, a CCD module or a CIS module. Further, a fixed image reader fixed to the stop reading region 112 and a moving reader moving along the flatbed contact glass 113 in the moving reading region 111 may be provided.

Right and left movable side guide plates 123 for positioning the document sheet set in the ADF 80 in a sheet width direction orthogonal to the sheet feeding direction are attached to the document placing tray 121. These right and left movable side guide plates 123 are relatively movable toward and away from each other to make the document placing tray 121 and the center in the width direction of the document sheet to coincide with each other. Note that the right and left movable side guide plates 123 may be arranged so as to bring one edge of the document sheet in contact with one edge side of the document placing tray 121 and to leave the other edge movable.

The ADF 80 is covered with a cover 138 that can open and close at least an upper portion of the ADF 80. Further, a main guide portion that defines the document conveyance passage 122 of the ADF 80 is formed by a rib formed on the cover 138 and the like. Meanwhile, the ADF 80 includes a calling roller 124 for calling the document set on the document placing tray 121 in the sheet feeding direction, a feed roller 125 for feeding the document called in the sheet feeding direction by the calling roller 124 toward the document conveyance passage 122, and a separation pad 143.

The ADF 80 includes a conveyor 127 that conveys the document fed in the document conveyance passage 122 by the feed roller 125 onto the DF contact glass 114 with an image readable posture, and conveys the document after the image has been read to a discharge port 136.

The conveyor 127 inverts the document sheet separated and carried in by the feed roller 125 and the like to be folded back along the document conveyance passage 122 and conveys the document sheet to pass through a predetermined reading position on the upper surface of the DF contact glass 114. For such document conveyance, a pair of first conveying rollers 128, a pair of second conveying rollers 129, and a registration sensor 131 to detect a leading edge in the sheet conveying direction of the document sheet are provided on an upstream side with respect to the DF contact glass 114 in the document conveyance passage 122.

The document sheet separated by the feed roller 125 and the like is conveyed to pass over the DF contact glass 114 by the pair of first conveying rollers 128 and the pair of second conveying rollers 129. Then, the image on the surface of the document is read at appropriate timing by the image reader 116 based on a leading edge detection timing of the document sheet by the registration sensor 131.

For example, when the leading edge of the document sheet is detected by the registration sensor 131, timing when the leading edge position of the document sheet detectable by pulse count of a document sheet feeding motor as a drive source reaches the reading position on the DF contact glass 114 is specified. A gate signal indicating an effective image region in a sub-scanning direction on the surface of the document sheet starts to be transmitted and continues to be transmitted until the trailing end position of the document sheet passes through the reading position.

In a case in which reading of a back side image of the document sheet is requested, the back side image is read by a back side image reading module 135 (second image reader) including a contact-type image sensor for back side reading.

The back side image reading module 135 includes a light source that irradiates the document sheet with light based on a lighting signal from a controller, a plurality of sensor chips that receives reflected light from the document sheet, and a plurality of amplifiers that amplifies signals output from the sensor chips. The back side image reading module 135 further includes an analog/digital (A/D) converter that converts the signal amplified by the amplifier from an analog signal to a digital signal, and an image processor that applies image processing to the digital converted signal.

The back side image reading module 135 further includes an output control circuit that controls an output of a signal stored in a frame memory based on a timing signal from the controller, an interface circuit that outputs a signal from the output control circuit to the image forming apparatus 100, and the like. The timing to read the back side image by the back side image reading module 135 is controlled substantially similarly to the timing to read the front side image, and the document after reading is ejected to a document sheet ejection tray 139.

A reading outlet roller 132 that conveys the document, from which the front side image has been read, toward the back side image reading module 135 is provided on a downstream side with respect to the DF contact glass 114 in the document conveyance passage 122. A white guide member 133 facing the back side image reading module 135 is provided on a downstream side with respect to the reading outlet roller 132, and a document sheet ejection roller 137 located on a downstream side with respect to the back side image reading module 135 and the white guide member 133 is provided.

The white guide member 133 has a guide function to move the conveyed document along the back side image reading module 135 and also has a white reference surface for shading correction arranged to face the entire back side image reading module 135 in a main-scanning direction.

Figure 13:
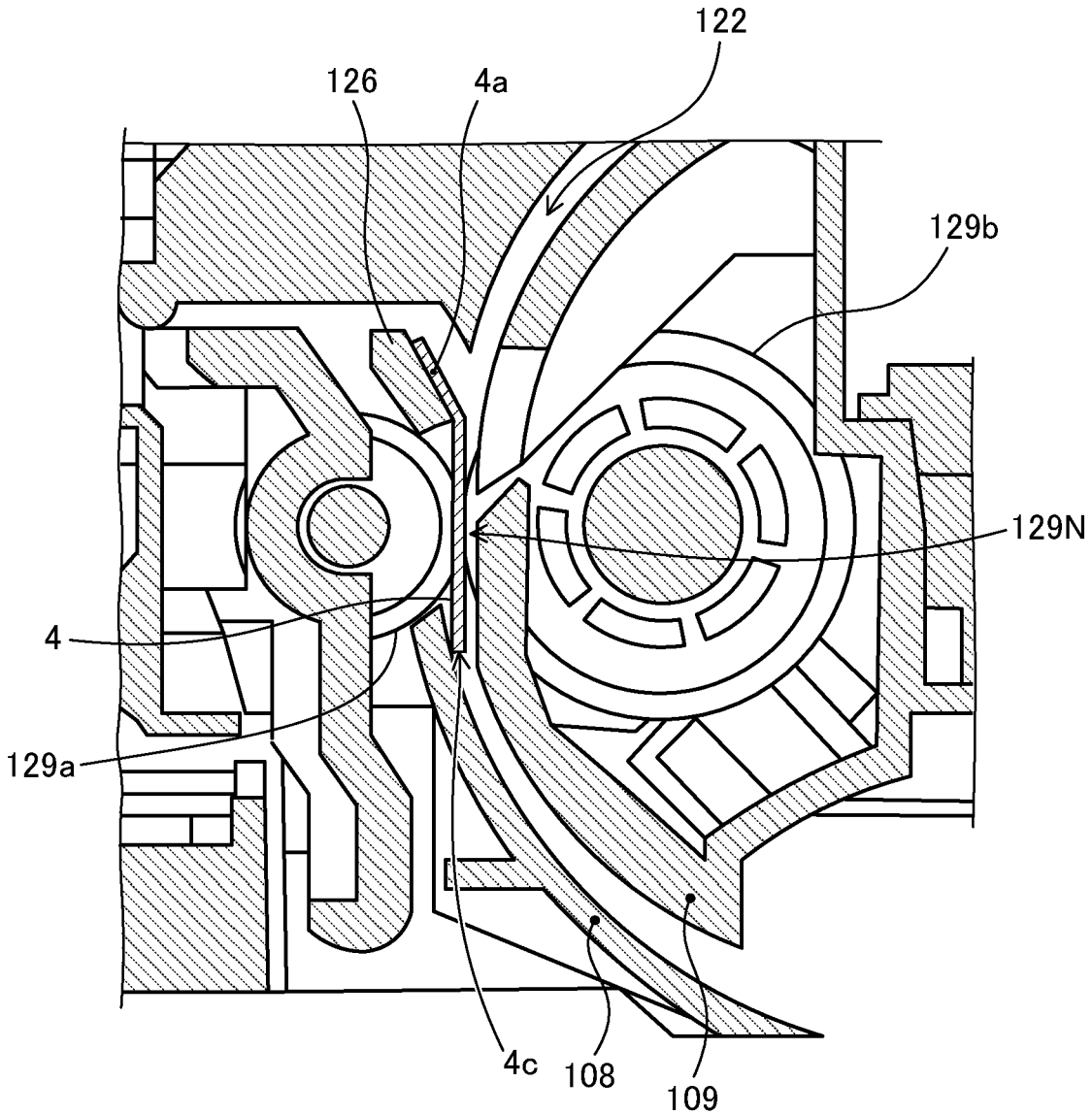
FIG. 13 is an enlarged explanatory view of a vicinity of a pair of second conveying rollers in an auto document feeder (ADF) of the image reading device of the variation.

FIG. 13 is an enlarged explanatory view of a vicinity of the pair of second conveying rollers 129 in the ADF 80 of the image reading device 300 of the variation. The ADF 80 includes a document turn portion outer guide member 108 and a document turn portion inner guide member 109 as conveyance passage defining bodies that define the document conveyance passage 122 that functions as a sheet conveyance passage. Further, the pair of second conveying rollers 129 includes an outer second conveying roller 129*a* and an inner second conveying roller 129*b* to form a second conveying nip region 129N. The outer second conveying roller 129*a* and the inner second conveying roller 129*b*, each of which functions as a nip forming body. When the inner second conveying roller 129*b* that is a drive roller is driven to rotate in a counterclockwise direction in FIG. 13, the outer second conveying roller 129*a* is driven to follow in a sheet conveying direction in FIG. 13 to convey the document gripped by the second conveying nip region 129N in a downward direction in FIG. 13 that is the downstream side in the sheet conveying direction.

Further, as illustrated in FIG. 13, a flexible sheet 4 arranged to straddle the second conveying nip region 129N in the document conveyance passage 122 is provided. The upstream-side secured portion 4*a* including the upstream-side end portion of the flexible sheet 4 is affixed and secured to a fixing target portion 126 that is located at an upstream-side portion with respect to the second conveying nip region 129N in the document turn portion outer guide member 108. Further, the sheet downstream end 4*c* that is the downstream-side end portion in the sheet conveying direction of the flexible sheet 4 is a free end and is located on the downstream side in the sheet conveying direction with respect to the second conveying nip region 129N. With such a configuration, the collision noise on the conveyance passage defining body immediately after the document has passed through the second conveying nip region 129N can be decreased, and the operating sound in the image reading device 300 can be decreased, similarly to the above-described embodiment.

In the above-described embodiment, a case in which the nip forming member that forms the conveying nip region includes two roller members has been described. However, the members included in the nip forming member are not limited to the two roller members. For example, the nip region may be formed by a belt member and a roller member. Further, the conveying nip region may be formed by a rotary body and a non-rotary body such that one of members included in the nip forming member is a rotary body that performs surface movement such as a belt member or a roller member and the other is a non-rotary body that does not perform the surface movement such as a guide member or a sensor surface.

The "sheet" conveyed by the sheet conveying device of this disclosure includes a paper, a coated paper, an overhead projector (OHP) sheet, a label paper, a film, a piece of cloth, and the like. Further, the "sheet" includes a resin-made sheet, front-back protective sheet, a metal-made sheet, an electronic circuit board material to which a metal foil such as a copper foil or plating is applied, a special film, a plastic film, a prepreg, an electronic circuit board sheet, and the like. The prepreg is a sheet-like material in which carbon fiber or the like is impregnated with a resin in advance. An example of the prepreg includes a sheet-like reinforced plastic molded material obtained by causing a fibrous reinforcing material, such as carbon fiber or glass cloth, to be impregnated with a thermosetting resin or the like in which additives such as a curing agent and a colorant are mixed, and heating or drying the material to be in a semi-cured state.

Further, the "image forming apparatus" having the configuration of the sheet conveying device includes an apparatus that causes a developing agent or an ink to adhere to a medium such as a paper, an OHP sheet, yarn, fiber, cloth, leather, metal, plastic, glass, wood, ceramics to form an image. Further, the "image formation" includes not only providing an image having meaning such as characters and graphics to a medium but also providing an image having no meaning such as a pattern to a medium.

The above description is merely an example, and specific effects are exerted in each of the following aspects.

Aspect 1.

A sheet conveying device (for example, the image forming apparatus 100 and the ADF 80) includes conveyance passage forming bodies (for example, the relay upstream guide member 6, the relay downstream guide member 8, the relay inner guide member 9, the merging guide member 24, the document turn portion outer guide member 108, and the document turn portion inner guide member 109) that define a sheet conveyance passage (for example, the main body sheet feeding and conveyance passage 21, the extension sheet feeding and guiding passage 23, and the post-relay nip conveyance passage 18, and the document conveyance passage 122), a nip forming body (for example, the pair of relay rollers 12, the outer second conveying roller 129*a*, and the inner second conveying roller 129*b*) that forms a conveying nip region (for example, the relay nip region 12N and the second conveying nip region 129N) in the sheet conveyance passage, and a flexible plate body (for example, the flexible sheet 4) having a support portion (for example, the secured portion 4*a*) to be attached to another body (for example, the relay upstream guide member 6 and the fixing target portion 126) and having a downstream-side end portion (for example, the sheet downstream end 4*c*) as a free end in a sheet conveying direction. The support portion of the flexible plate body is located on an upstream side in the sheet conveying direction with respect to the conveying nip region. The free end is located on a downstream side in the sheet conveying direction with respect to the conveying nip region.

According to Aspect 1, as described in the above embodiment, a collision noise due to the sheet passing through the conveying nip region colliding with the conveyance passage defining body can be restrained. This is due to the following reason. That is, there is a difference in level between a surface of the nip forming body immediately after the sheet has passed through the conveying nip region and the conveyance passage defining body on a downstream side in the sheet conveying direction with respect to the conveying nip region. In a state where a force toward the conveyance passage defining body is acting on a trailing end of the sheet, such as in a case in which the sheet conveyance passage on a downstream side in the sheet conveying direction with respect to the conveying nip region is curved and the sheet is bent, the sheet is moved to bounce by the difference in level and collides with the conveyance passage defining body when the trailing end of the sheet passes through the conveying nip region.

In Aspect 1, the flexible plate body is located on the downstream side in the sheet conveying direction with respect to the conveying nip region, and therefore the trailing end of the sheet having passed through the conveying nip region collides with the flexible plate body before colliding with the conveyance passage defining body, and the flexible plate body is bent to absorb collision energy. The amount of displacement of a portion in the flexible plate body, with which the trailing end of the sheet collides, at the time when the sheet collides, is dependent on a distance from the support portion to the portion with which the trailing end of the sheet collides, and the amount of displacement becomes larger as the distance is longer, and the collision energy can be more easily absorbed.

In Aspect 1, the support portion is provided on the upstream side in the sheet conveying direction with respect to the conveying nip region. Therefore, the distance between the portion with which the trailing end of the sheet having passed through the conveying nip region collides and the support portion in the flexible plate body can be made longer than a configuration in which the support portion is provided on a downstream side in the sheet conveying direction with respect to the conveying nip region. With the configuration, the portion with which the trailing end of the sheet collides in the flexible plate body becomes easily deformed in a direction of absorbing the collision and can easily absorb the collision energy. Therefore, the collision noise can be decreased. Therefore, in Aspect 1, the collision noise due to the sheet passing through the conveying nip region colliding with the conveyance passage defining body can be further restrained than conventional cases.

Aspect 2.

In Aspect 1, the flexible plate body is deformable by contact of a sheet.

According to Aspect 2, as described in the above embodiment, the flexible plate body is deformed by contact of the sheet to absorb the collision energy of when the trailing end of the sheet collides with by deformation, thereby to implement a configuration to reduce the collision noise.

Aspect 3.

In Aspect 1 or Aspect 2, the conveying nip region is located at a merging portion between two upstream-side sheet conveyance passages, more specifically, a first upstream-side sheet conveyance passage (for example, the main body sheet feeding and conveyance passage 21) and a second upstream-side sheet conveyance passage (for example, the extension sheet feeding and guiding passage 23).

According to Aspect 3, as described in the above embodiment, the configuration in which, after sheets (for example, the sheets P) have been conveyed from the upstream-side sheet conveyance passages, the trailing end of either one of the sheets that has passed through the conveying nip region comes in contact with the flexible plate body can be implemented.

Aspect 4.

In any one of Aspects 1 to 3, the flexible plate body has a bent portion (for example, the sheet folded portion 4*b*) and a surface on a side, where a sheet passes through, of the bent portion is bent in a manner of a mountain fold.

According to Aspect 4, as described in the above embodiment, even the configuration including the bent portion in the flexible plate body can convey the sheet without affecting conveyability of the sheet.

Aspect 5.

In any one of Aspects 1 to 4, the flexible plate body has the bent portion (for example, the sheet folded portion 4*b*), and the bent portion is located on an upstream side in the sheet conveying direction with respect to the conveying nip region.

According to Aspect 5, as described in the above embodiment, the sheet having passed through the conveying nip region can be conveyed without affecting conveyability of the sheet.

Aspect 6.

In any one of Aspects 1 to 5, the conveyance passage defining body (the relay downstream guide member 8 or the like) on an immediately downstream side of the conveying nip region in the sheet conveying direction has a shape in which a first region (for example, the inner region α) including a range where the nip forming body is arranged in a width direction, is located at a position more distant from a position where a conveyed sheet passes through than a second region (for example, the outer region β) outside the first region in the width direction, and the flexible plate body is arranged to straddle the first region and the second region.

According to Aspect 6, as described in the above embodiment, the trailing end of the sheet having passed through the conveying nip region can be received by the flexible plate body even when the width of the sheet is short.

Aspect 7.

In any one of Aspects 1 to 6, the nip forming body is arranged in a curved portion such as the turn portion on the sheet conveyance passage, and the support portion of the flexible plate body is secured to the conveyance passage defining body (for example, the relay upstream guide member 6) that defines an outside of the curved portion on an upstream side in the sheet conveying direction with respect to the conveying nip region.

According to Aspect 7, as described in the above embodiment, even when the trailing end of the sheet having passed through the conveying nip region is moved to bounce toward the conveyance passage defining body due to stiffness of the sheet, the flexible plate body receives the trailing end of the sheet to reduce the collision noise.

Aspect 8.

In Aspect 7, the free end of the flexible plate body is in contact with the conveyance passage defining body that defines an outside of the curved portion on a downstream side in the sheet conveying direction with respect to the conveying nip region.

According to Aspect 8, as described in the above embodiment, the position of the downstream-side end portion in the sheet conveying direction of the flexible plate body is stabilized and stability of conveyance of the sheet can be enhanced.

Aspect 9.

In any one of Aspects 1 to 8, the flexible plate body has a plurality of notches extending in the sheet conveying direction.

According to Aspect 9, as described in the embodiment with reference to FIG. 10, the flexible plate body becomes easily deformed and can easily absorb the collision energy, thereby to easily reduce the collision noise.

Aspect 10.

In Aspect 9, the conveyance passage defining body on a downstream side in the sheet conveying direction with respect to the conveying nip region includes a plurality of ribs (for example, the inner rib 81 and the outer rib 82) in a width direction, the ribs protruding toward a position where a conveyed sheet passes through and extending along the sheet conveying direction, and a portion not the notches in the flexible plate body face the ribs.

According to Aspect 10, as described in the embodiment with reference to FIG. 10, even the configuration provided with the notches can prevent the trailing end of the sheet having passed through the conveying nip region from directly colliding with the ribs of the conveyance passage defining body to reduce the collision noise.

Aspect 11.

In any one of Aspects 1 to 10, the flexible plate body includes a rotary body avoiding notch portion (for example, the roller avoiding portion 4*d*) to avoid the nip forming body in a position corresponding to the conveying nip region in the sheet conveying direction, and a width of the rotary body avoiding notch portion is longer than a width (for example, the length W1 in the width direction of the relay outer roller 12*a*) of a rotary body included in the nip forming body and is shorter than a width of a sheet having a minimum size conveyable in the sheet conveying device.

According to Aspect 11, as described in the above embodiment, even when the sheet P having the minimum size is conveyed, the collision noise with the conveyance passage defining body immediately after the sheet P has passed through the relay nip region 12N can be decreased.

Aspect 12.

An image reading device (for example, the image reading device 300) including a sheet conveying device (for example, the ADF 80) to convey a sheet (for example, the sheet P) and an image reader (for example, the scanner 90) to read an image on the sheet conveyed by the sheet conveying device, in which the sheet conveying device according to any one of Aspects 1 to 11 is included as the sheet conveying device.

According to Aspect 12, as described in the variation, operating sound in the image reading device can be decreased.

Aspect 13.

An image forming system (for example, the image forming system 500) including an image reading device (for example, the image reading device 300), and an image forming device (for example, the image forming device 10) to form an image based on image information read by the image reading device, in which the image reading device according to Aspect 12 is included as the image reading device.

According to Aspect 13, as described in the variation, operating sound in the image reading device included in the image forming apparatus can be decreased.

Aspect 14.

An image forming apparatus (for example, the image forming apparatus 100) including an image forming device (for example, the image forming device 10) to form an image on a conveyed sheet (for example, the sheet P), in which a configuration of the sheet conveying device according to any one of Aspects 1 to 11 is included as a configuration to covey the sheet.

According to Aspect 14, as described in the above embodiment, operating sound in the image forming apparatus can be decreased.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet conveying device comprising:

conveyance passage forming bodies to define a sheet conveyance passage;

a nip forming body to form a conveying nip region in the sheet conveyance passage; and a flexible plate body having a support portion to be attached to one of the conveyance passage forming bodies and having a downstream-side end portion as a free end in a sheet conveying direction, the support portion of the flexible plate body being located on an upstream side in the sheet conveying direction with respect to the conveying nip region, and the free end being located on a downstream side in the sheet conveying direction with respect to the conveying nip region, wherein the flexible plate body has a bent portion, and wherein the bent portion is located on an upstream side in the sheet conveying direction with respect to the conveying nip region, wherein the flexible plate body is configured to contact a sheet at a position upstream from the conveying nip region in the sheet conveying direction and guide the sheet toward the conveying nip region, the free end being configured to contact an outer rib of one of the conveyance passage forming bodies downstream from the nip forming body in the sheet conveyance direction.

2. The sheet conveying device according to claim 1, wherein the flexible plate body is deformable by contact of a sheet.

3. The sheet conveying device according to claim 1, wherein the conveying nip region is located at a merging portion between a first upstream-side sheet conveyance passage and a second upstream-side sheet conveyance passage.

4. The sheet conveying device according to claim 1, wherein a surface of the bent portion facing the sheet when the sheet passes by is bent in a manner of a mountain fold.

5. The sheet conveying device according to claim 1, wherein a first conveyance passage forming body, of the conveyance passage forming bodies, on an immediately downstream side of the conveying nip region in the sheet conveying direction has a plurality of ribs protruding from first and second regions thereof, and a shape in which the first region, including a range where the nip forming body is arranged in a width direction, is located at a position more distant in a direction normal from a position where a conveyed sheet passes through the conveying nip region than the second region outside the first region in the width direction, and wherein the flexible plate body is arranged to straddle the first region and the second region.

6. The sheet conveying device according to claim 5, wherein ribs in the second region protrude further from the first conveyance passage forming body than ribs on the first region.

7. The sheet conveying device according to claim 1, wherein the nip forming body is arranged in a curved portion on the sheet conveyance passage, and wherein the support portion of the flexible plate body is secured to one of the conveyance passage forming bodies forming an outside of the curved portion on an upstream side in the sheet conveying direction with respect to the conveying nip region.

8. The sheet conveying device according to claim 7, wherein the free end of the flexible plate body is in contact with one of the conveyance passage forming bodies forming an outside of the curved portion on a downstream side in the sheet conveying direction with respect to the conveying nip region.

9. The sheet conveying device according to claim 1, wherein the flexible plate body has a plurality of notches extending in the sheet conveying direction.

10. The sheet conveying device according to claim 9, wherein one of the conveyance passage forming bodies on a downstream side in the sheet conveying direction with respect to the conveying nip region includes a plurality of ribs protruding toward a position at which a conveyed sheet passes through and extending along the sheet conveying direction, and wherein a portion of that flexible plate body other than the plurality of notches in the flexible plate body overlaps a portion of the plurality of ribs.

11. The sheet conveying device according to claim 1, wherein the flexible plate body includes a rotary body avoiding notch portion at a downstream end of the flexible plate body to avoid the nip forming body in a position corresponding to the conveying nip region in the sheet conveying direction, and wherein a width of the rotary body avoiding notch portion is greater than a width of a rotary body included in the nip forming body and is smaller than a width of a sheet having a minimum size conveyable in the sheet conveying device.

12. The sheet conveying device according to claim 1, wherein the bent portion is located between the support portion and the conveying nip region in the sheet conveying direction.

13. The sheet conveying device according to claim 1, wherein the bent portion is configured to contact the sheet in the sheet conveying passage.

14. An image forming apparatus comprising:

an image forming device to form an image on a conveyed sheet; and the sheet conveying device according to claim 1.

15. An image forming system comprising:

the image forming apparatus according to claim 14; and an image reader to read an image on the sheet conveyed by the sheet conveying device.

16. An image reading device comprising:

the sheet conveying device according to claim 1 to convey a sheet; and an image reader to read an image on the sheet conveyed by the sheet conveying device.

17. An image forming system comprising:

the image reading device according to claim 16; and an image forming device to form an image based on image information read by the image reading device.

* * * * *